US006468947B1

(12) United States Patent
Falcone et al.

(10) Patent No.: US 6,468,947 B1
(45) Date of Patent: Oct. 22, 2002

(54) LUBRICANTS WITH IMPROVED STABILITY FOR MAGNETIC RECORDING MEDIA

(75) Inventors: Samuel J. Falcone; Michael J. Stirniman; Seog W. Lee, all of San Jose, CA (US)

(73) Assignee: Seagate Technology LLC, Scotts Valley, CA (US)

( * ) Notice: Subject to any disclaimer, the term of this patent is extended or adjusted under 35 U.S.C. 154(b) by 0 days.

(21) Appl. No.: 09/533,208

(22) Filed: Mar. 23, 2000

Related U.S. Application Data

(60) Provisional application No. 60/126,373, filed on Mar. 26, 1999.

(51) Int. Cl.[7] ..... C10M 111/04

(52) U.S. Cl. ..... 508/555; 508/562; 508/582; 508/428; 508/65.4

(58) Field of Search ..... 508/555, 562, 508/582, 428

(56) References Cited

U.S. PATENT DOCUMENTS

| | | | | |
|---|---|---|---|---|
| 3,632,744 | A | | 1/1972 | Paulsen et al. |
| 3,810,874 | A | | 5/1974 | Mitsch et al. |
| 4,085,137 | A | | 4/1978 | Mitsch et al. |
| 4,097,388 | A | | 6/1978 | Snyder, Jr. et al. |
| 4,152,487 | A | | 5/1979 | Yanagisawa |
| 4,174,461 | A | * | 11/1979 | Sianesi et al. |
| 4,267,238 | A | | 5/1981 | Chernega |
| 4,268,556 | A | | 5/1981 | Pedrotty |
| 4,307,156 | A | | 12/1981 | Yanagisawa |
| 4,404,247 | A | | 9/1983 | Dominguez-Burguette et al. |
| 4,647,413 | A | | 3/1987 | Savu |
| 4,696,845 | A | | 9/1987 | Yanagisawa |
| 4,849,305 | A | | 7/1989 | Yanagisawa |
| 4,889,939 | A | | 12/1989 | Caporiccio et al. |
| 4,897,211 | A | | 1/1990 | Dekura et al. |
| 5,093,211 | A | | 3/1992 | Kudo et al. |
| 5,104,709 | A | | 4/1992 | Kokaku et al. |
| 5,124,058 | A | * | 6/1992 | Corti et al. |
| 5,128,216 | A | | 7/1992 | Ng |
| 5,219,651 | A | | 6/1993 | Shoji et al. |
| 5,223,342 | A | | 6/1993 | Shoji et al. |
| 5,453,539 | A | | 9/1995 | Kondo et al. |
| 5,498,457 | A | | 3/1996 | Ishihara et al. |
| 5,506,309 | A | | 4/1996 | Bierschenk et al. |
| 5,591,503 | A | | 1/1997 | Pews et al. |
| 5,718,833 | A | | 2/1998 | Yamamoto et al. |
| 5,776,602 | A | | 7/1998 | Ueda et al. |
| 5,789,534 | A | | 8/1998 | Koiki et al. |
| 5,820,964 | A | | 10/1998 | Nakakawaji et al. |
| 5,900,318 | A | | 5/1999 | Yanagisawa |
| 5,908,817 | A | | 6/1999 | Perettie et al. |
| 6,096,694 | A | * | 8/2000 | Tei et al. |

FOREIGN PATENT DOCUMENTS

| | | |
|---|---|---|
| JP | 63-293719 | 11/1988 |

* cited by examiner

*Primary Examiner*—Jerry D. Johnson

(57) ABSTRACT

A lubricant composition comprising a first fluoropolyether and a second fluoropolyether having nitrogen containing end-group exhibits improved resistance to acid and thermal decomposition. Embodiments include a lubricant composition containing a perfluorinate polyalkylether admixed with a perfluorinated polyalkylether having amide terminal groups and applying the composition to the surface of a magnetic recording medium to form a homogeneous lubricant topcoat thereon.

2 Claims, 4 Drawing Sheets

LUBRICANTS WITH IMPROVED STABILITY FOR MAGNETIC RECORDING MEDIA

CROSS-REFERENCE TO PROVISIONAL APPLICATIONS

This application claims priority from provisional patent application Ser. No. 60/126,373, filed Mar. 26, 1999, the entire disclosure of which is herein incorporated by reference.

FIELD OF THE INVENTION

The present invention relates to lubricant compositions for lubricating magnetic data, particularly rotatable magnetic recording media, such as thin film magnetic disks having textured surfaces and a lubricant topcoat for contact with cooperating magnetic transducer heads.

BACKGROUND OF THE INVENTION

Thin film magnetic recording disks and disk drives are conventionally employed for storing large amounts of data in magnetizable form. In operation, a typical contact start/stop (CSS) method commences when a data transducing head begins to slide against the surface of the disk as the disk begins to rotate. Upon reaching a predetermined high rotational speed, the head floats in air at a predetermined distance from the surface of the disk, where it is maintained during reading and recording operations. Upon terminating operation of the disk drive, the head again begins to slide against the surface of the disk and eventually stops in contact with and pressing against the disk. Each time the head and disk assembly is driven, the sliding surface of the head repeats the cyclic operation consisting of stopping, sliding against the surface of the disk, floating in the air, sliding against the surface of the disk, and stopping.

For optimum consistency and predictability, it is necessary to maintain each transducer head as close to its associated recording surface as possible, i.e., to minimize the flying height of the head. Accordingly, a smooth recording surface is preferred, as well as a smooth opposing surface of the associated transducer head. However, if the head surface and the recording surface are too flat, the precision match of these surfaces gives rise to excessive stiction and friction during the start up and stopping phases, thereby causing wear to the head and recording surfaces, eventually leading to what is referred to as a "head crash." Thus, there are competing goals of reduced head/disk friction and minimum transducer flying height.

Conventional practices for addressing these apparent competing objectives involve providing a magnetic disk with a roughened recording surface to reduce the head/disk friction by technique generally referred to as "texturing." Conventional texturing techniques involve mechanical polishing or laser texturing the surface of a disk substrate to provide a texture thereon prior to subsequent deposition of layers, such as an underlayer, a magnetic layer, a protective overcoat, and a lubricant topcoat, wherein the texture on the surface of the substrate is intended to be substantially replicated in the subsequently deposited layers.

A typical longitudinal recording medium is depicted in FIG. 1 and comprises a substrate 10, typically an aluminum (Al)-alloy, such as an aluminum-magnesium (Al—Mg)-alloy, plated with a layer of amorphous nickel-phosphorus (NiP). Alternative substrates include glass, glass-ceramic materials and graphite. Substrate 10 typically contains sequentially deposited on each side thereof a chromium (Cr) or Cr-alloy underlayer 11, 11', a cobalt (Co)-base alloy magnetic layer 12, 12', a protective overcoat 13, 13', an a lubricant topcoat 14, 14'. Cr underlayer 11, 11' can be applied as a composite comprising a plurality of sub-underlayers 11A, 11A'.

The protective overcoat desirably possesses high durability, density and hardness to protect the underlying magnetic layer providing wear resistance and encouraging durability of the magnetic recording medium arrangement. Typically, a thin film of zirconium oxide, silicon oxide or carbon is used as a protective overcoat.

Chromium underlayer 11, 11', Co-base alloy magnetic layer 12, 12' and protective overcoat 13, 13' are usually deposited by sputtering techniques performed in an apparatus containing sequential deposition chambers. A conventional Al-alloy substrate is provided with a NiP plating, primarily to increase the hardness of the Al substrate, serving as a suitable surface to provide a texture which is substantially reproduced on the disk surface.

In accordance with conventional practices, a lubricant topcoat is uniformly applied over the protective overcoat to prevent wear between the disk and head interface during drive operation. Excessive wear of the protective overcoat increases friction between the head and disk, thereby causing catastrophic drive failure. Conversely, excess lubricant at the head-disk interface causes high stiction between the head and disk. If stiction is excessive, the drive cannot start and, likewise, catastrophic failure occurs.

The drive towards ever increasing recording density, and faster data transfer rates and the resulting smoother disk surfaces and lower flying heights, has served as an impetus for the development of new lubricants to serve as a lubricating topcoat overlying the protective overcoat. Such lubricants must perform a variety of different purposes requiring diverse characteristics and attributes. For example, the lubricant forming the topcoat is preferably chemically inert, possesses a low vapor pressure, low surface tension, high thermal stability, stability under high shear stress and good boundary lubrication properties. Moreover, it is critical that the lubricant tightly adheres to the underlying surface over the lifetime of the magnetic recording media.

The entire disc surface of a magnetic recording disc, however, is not ideal for reading and writing data. In particular, disc surfaces have asperities, i.e. protrusions on surfaces of the disks, which interfere with the flying characteristics of the data head, as well as the read and write operations of the data head. In operation, the head can come into contact with asperities while the head flies above the surface of the disc. Potentially, this undesirable contact can cause data written to a particular location on a disc to be lost. In an effort to alleviate such occurrences, manufactures commonly burnish the surfaces of disks to reduce asperities located thereon. Typical burnishing processes, however, cause contamination of ceramic oxides, such as aluminum oxide, on the disk's surface which can catalyze the decomposition of the lubricant topcoat layer resulting in reduced tribological properties.

Several classes of lubricants may satisfy some of the desired properties. Among the many lubricants available, liquid perfluoropolyethers (PFPE) are the most utilized for forming topcoat lubricants on magnetic recording media. PFPE's have been reported for use as lubricating magnetic media in, for example, U.S. Pat. No. 3,778,308. PFPE having a variety of polar end-groups are known (see, e.g. U.S. Pat. Nos. 3,810,874; 4,085,137 and 4,647,413) and have been used in an attempt to improve adhesion of the lubricant to the magnetic medium (see, e.g. U.S. Pat. Nos. 4,268,556; 4,696,845; 4,889,939; 5,128,216). Their preparation has also been widely reported (see, e.g., U.S. Pat. Nos. 3,810,874 and 5,506,309)

Typical conventional lubricants, such as perfluoroalkylpolyether (PFPE) fluids such as Fomblin Z-DOL, Fomblin TX, and Fomblin Z-Tetraol, etc., generally have 2–4 polar groups at either end of a linear perfluorinated polyalkylether backbone. The functionalized end groups are considered necessary to provide direct bonding, and thus, improved adhesion of the lubricant topcoat to the recording media. Polar functional groups, however, are not necessarily chemically inert and consequently, such conventional lubricants may disadvantageously undergo chemical reactions prior to their application or while on the magnetic medium tending to decrease their adhesion to the disk surface. Undesirable chemical reactions further include degradation of the lubricant itself. Contamination by Lewis acids, such as aluminum oxide, on magnetic recording media further promote degradation of the lubrications.

Thus, a significant factor in the performance of a lubricant topcoat is the ability of the lubricant to resist decomposition over time, particularly decomposition by acid catalysis. Lubricants that can adhere to the surface of magnetic media and resist degradation provide improved tribology and durability.

In view of the criticality of the lubricant topcat, there is a continuing need for improved adherence of the lubricant to the magnetic recording medium, particularly to a carbon-based protective overcoat. There also exists a need for a lubricant topcoat providing improved durability, stiction and wear performance, particularly under conditions of high stress, temperature, and humidity.

SUMMARY OF THE INVENTION

An advantage of the present invention is a lubricant composition with improved resistance to degradation, particularly, resistance to thermal and acid decomposition.

Another advantage of the present invention is a magnetic recording medium comprising a lubricant composition exhibiting high stability to degradation.

Additional advantages and other features of the invention will be set forth in part in the description which follows and in part will become apparent to those having ordinary skill in the art upon examination of the following or may be learned from the practice of the invention. The advantages of the invention may be realized and obtained as particularly pointed out in the appended claims.

According to the present invention, the foregoing and other advantages are achieved in part by a magnetic recording medium comprising a magnetic layer and a lubricant composition on the magnetic layer, wherein the lubricant composition comprises a first fluoropolyether and a decomposition inhibiting amount of a second fluoropolyether having at least one nitrogen containing end group.

According to embodiments of the present invention, the nitrogen containing end group of the lubricant molecule comprises one or more amine and/or amide groups. It is advantageous to have one or more amine and/or amide groups as end-groups on the second fluoropolyether to reduce catalytic degradation of the lubricant composition.

In an embodiment of the present invention, the second fluoropolyether has the following formula:

$$Z—(A)_q$$

wherein Z is a fluorinated polyalkylether; A is an amine or amide group; and q is an integer of 1 to about 4.

In an embodiment of the present-invention, Z is a perfluoropolyether comprising a plurality of $—(C_aF_{2a}O)_n—$ repeating units, wherein subscript a is independently in each such units an integer of from 1 to about 10 and n is an integer from 2 to about 100 and A is a $NR_1R_2$ or $CONR_1R_2$ group wherein $R_1$ and $R_2$ are independently H, substituted or unsubstituted alkyl, or substituted or unsubstituted aryl groups.

Another aspect of the present invention is a method of manufacturing a magnetic recording medium. The method comprises forming a magnetic layer on a substrate; and forming a lubricant topcoat on the magnetic layer, wherein the lubricant topcoat comprises a first fluoropolyether and a decomposition inhibiting amount of a second fluoropolyether having a nitrogen containing end-group.

Another aspect of the present invention is a lubricant composition comprising a first fluoropolyether and a decomposition-inhibiting amount of a second fluoropolyether, wherein the second fluoropolyether has a nitrogen containing end-group.

Embodiments include a lubricant composition wherein the first fluoropolyether is a perfluoropolyether; the second polyether is a fluoropolyether having an amide group, such as a $CONR_1R_2$ group wherein $R_1$ and $R_2$ are independently H, substituted or unsubstituted alkyl, or substituted or unsubstituted aryl groups; and the composition comprises no less than about 20 weight percent (wt. %) of the second fluoropolyether.

Additional advantages of the present invention will become readily apparent to those having ordinary skill in the art from the following detailed description, wherein the embodiments of the invention are described, simply by way of illustration of the best mode contemplated for carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE DRAWINGS

The following detailed description of the embodiments of the present invention can best be understood when read in conjunction with the following drawings, wherein.

DESCRIPTION OF THE INVENTION

Figure 1:
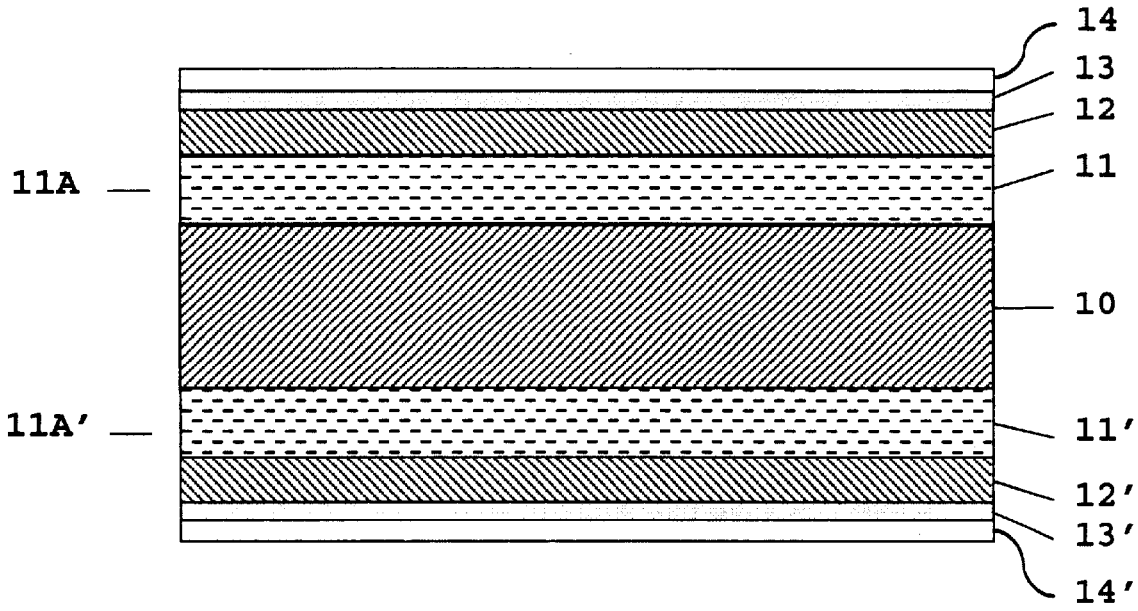
FIG. 1 schematically depicts a magnetic recording medium structure to which the present invention is applicable.

The present invention is directed to novel lubricant compositions which can be advantageously employed as lubricant topcoat on magnetic recording media with increased resistance to degradation. It as been found through experimentation that the lubricant endgroup has an effect on the thermal stability and/or susceptibility of a fluoropolyether lubricant to degradation, particularly degradation due to acid catalyzed cleavage.

For example, it was discovered that the more acidic the endgroup on the fluoropolyether lubricant, the lower the thermal stability was observed for the lubricant. It was then discovered that fluoropolyethers having a basic functionality, or more particular, fluoropolyethers having a nitrogen containing end-group are less prone to acid catalyzed decomposition and have superior thermal stability in an environment with Lewis acids, such as aluminum oxides, as found on the surface of magnetic medium. It was further discovered that by admixing a first fluoropolyether with a second fluoropolyether substituted with a nitrogen containing end-group, the admixture also exhibited superior thermal stability when exposed to acids in general.

By a nitrogen containing end-group, it is meant that the second fluoropolyether has a group or groups on one or more ends that can inhibit acid catalyzed degradation of the lubricant composition. Such groups can also be classified as either proton acceptors or having a pair of available electrons.

In accordance with the present invention, a lubricant composition is prepared by combining a first fluoropolyether, such as a convention PFPE, with a decomposition-inhibiting amount of a second fluoropolyether, such as a fluoropolyether having one or more terminal amines or amides. In an embodiment of the present invention, the second fluoropolyether is present in an amount of from about 20 weight percent (wt. %) to about 95 wt. %, e.g., from about 25 wt. % to about 60 wt. % in the lubricant composition.

Fluoropolyethers substituted with one or more amine or amide groups of the forgoing have the formula:

$$Z—(A)_q$$

wherein Z is a fluoropolyether, e.g. a polyether comprising fluoroalkylether, fluoroarylether, perfluoroalkylether or perfluoroarylether repeating units with one to ten carbon atoms randomly or uniformity distributed along the backbone of the polymer; A is an amine or amide, e.g a $NR_1R_2$ or $CONR_1R_2$ group wherein $R_1$ and $R_2$ are independently H, substituted or unsubstituted alkyl or aryl groups; and q is an integer of 1 to about 4.

In an embodiment of the present invention, the second fluoropolyether is a perfluoropolyether amide. For example, where Z comprises a plurality of $—(C_aF_{2a}O)_n—$ repeating units, wherein subscript a is independently in each such units an integer of from 1 to about 10 and n is an integer from 2 to about 100; and A is a $—CONR_1R_2$ group wherein $R_1$ and $R_2$ are independently H, substituted or unsubstituted alkyl, or substituted or unsubstituted aryl groups.

First, fluoropolyethers of the inventive lubricant composition include homopolymers, random polymers or block polymers, i.e. the repeating units of the fluoropolyether may be the same or different. In an embodiment of the present invention, the first fluoropolyether of the lubricant composition is a perfluoroalkylether, such as a perfluoropolyalkylether substituted with one or more hydroxyl groups.

The second fluoropolyether of the inventive lubricant composition can be a homopolymer, random polymer or block polymer. For example, Z can be a fluorinated polyalkylether with different repeating units randomly distributed along the backbone of the polymer or distributed a a block of one type of repeat unit and subsequent blocks of different repeat units along the backbone of the polymer. The decomposition-inhibiting second lubricant can be completely fluorinated or partially fluorinated and can be linear or branched.

In an embodiment of the present invention, Z is a perfluoroalkylpolyether comprising a plurality of $—(C_aF_{2a}O)_n—$ repeating units, wherein subscript a is independently in each such unit an integer of from 1 to about 10 and n is an integer from 1 to about 100.

A fluoropolyether having one or more amine or amide terminal groups of the present invention can be formed, for example, by derivatizing a variety of commercially available fluoropolyether lubricants, such as those conventionally employed to form lubricant topcoats on magnetic recording media. The second lubricant of the inventive composition can be prepared, for example, by combining a perfluoropolyether having a terminal carboxylic acid on either end thereof with, for example, a substituted or unsubstituted amine to yield a perfluoropolyetheramide terminated lubricant.

Alternatively, the lubricants having a nitrogen containing end-group can be prepared by fluorinating a hydrocarbon polyether having the end-group as such fluorination techniques are known.

Several specific examples of the decomposition-inhibiting lubricants according to the present invention are given in the table below.

TABLE

| Lubricant | Chemical Structure | q |
|---|---|---|
| 1 | 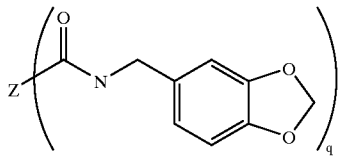 | 1 |
| 2 | 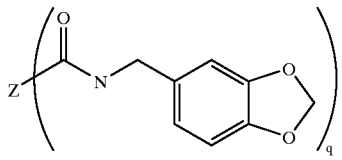 | 2 |
| 3 | 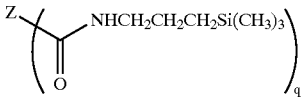 | 2 |
| 4 | 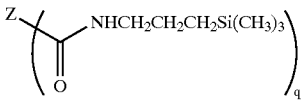 | 4 |
| 5 | 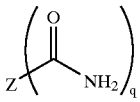 | 1 |
| 6 | 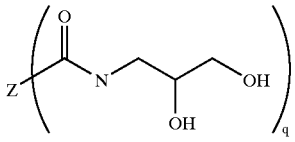 | 1 |
| 7 | 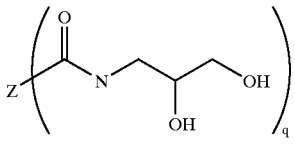 | 2 |

Where Z is $—(CF_2CF_2O)_n—(CF_2O)_m—$ and n an m are between 1 and about 100, e.g., approximately 10 to about 30.

The lubricant compositions of the present invention can be applied to a magnetic recording medium in any convenient manner as by dip coating the medium in a solution comprising the lubricant composition in a conventional organic solvent. The lubricant topcoat of the present invention can be applied to a magnetic recording medium, either directly on the magnetic layer or directly on a conventionally applied protective overcoat, particularly a carbon overcoat to form a substantially homogeneous topcoat lubricant, e.g., a topcoat which is free of any measurable disperse phase. In an embodiment of the present invention, the lubricant composition is dissolved in a conventional solvent, such as Freon, Vertrel XF or perfluorohexan (solvents available from Dupont), in a ratio of about 0.0001% to about 100% by (weight/weight), e.g. about 0.001% to about 1%. A typical magnetic recording medium, for example, a composite comprising a non-magnetic substrate having sequentially deposited on each side thereof an underlayer, a magnetic layer, and a protective carbon overcoat, is submerged in the solution containing the lubricant composition and then slowly withdrawn therefrom. In practicing the present invention, one can employ a convention lifter-type dipper to submerge the composite in the lubricant solution. One having ordinary skill in the art can easily optimize the duration of submergence and the speed of withdrawal to achieve a desired coating thickness.

Figure 2:
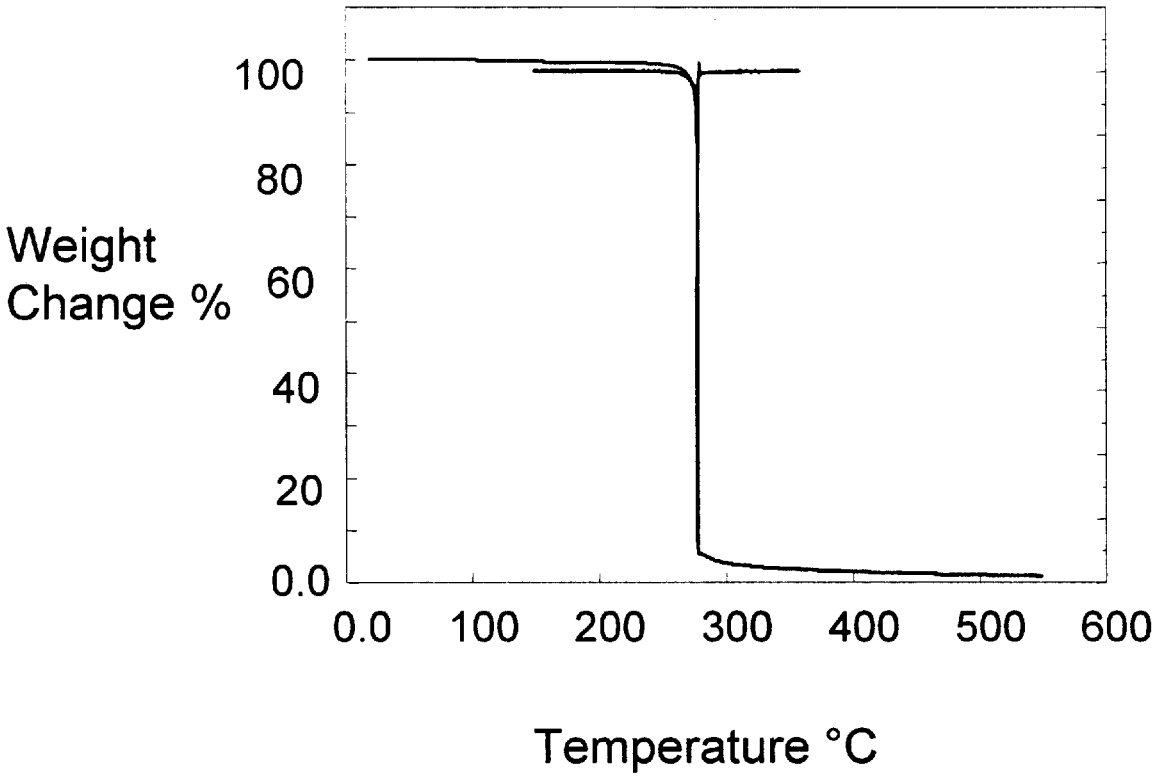
FIGS. 2 and 3 represent thermogravimetric analytical results comparing a conventional lubricant to the effectiveness of the inventive lubricant composition.

To demonstrate the improved resistance to acid induced decomposition of the inventive lubricant compositions, thermogravimetric analysis was conducted on conventional lubricants and compositions comprising conventional lubricants with a fluoropolyether having a nitrogen containing end-group. In performing the experiment, about 25 mg of conventional Z-DOL lubricant having a number average molecular weight of about 4500 was mixed with 5 mg of $Al_2O_3$. The thermal stability of the conventional Z-DOL lubricant is shown in FIG. 2, where the convention lubricant decomposes at approximately 270° C.

Figure 3:
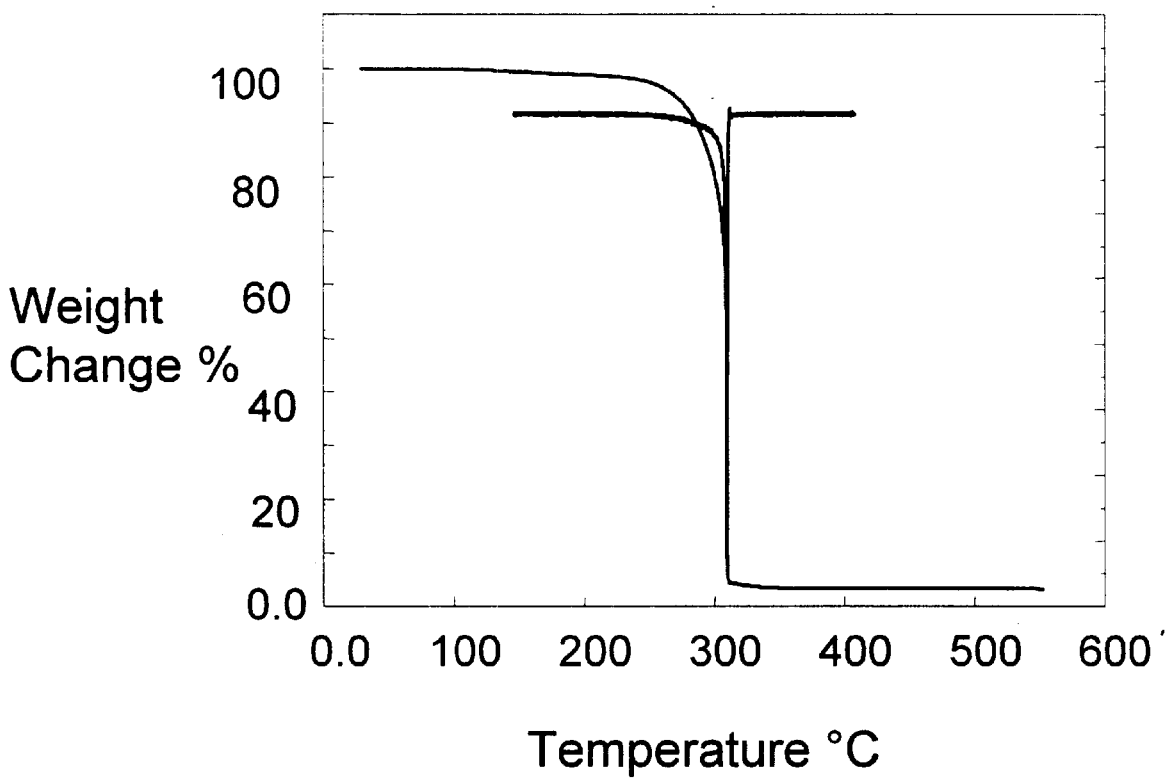

For comparison, lubricant compositions comprising about 3 parts by weight of the same conventional Z-DOL lubricant with one part by weight of an amide lubricant shown in Table 1 was prepared by admixing the respective lubricants together. Then about 25 mg of the lubricant composition was mixed with about 5 mg of $Al_2O_3$ and placed in a thermal gravimetric analyzer. As shown in FIG. 3, the thermal stability of the inventive lubricant compositions surpasses that of conventional Z-dol. The 1:3 lubricant compositions have a thermal stability of approximately 310° C.

Figure 4:
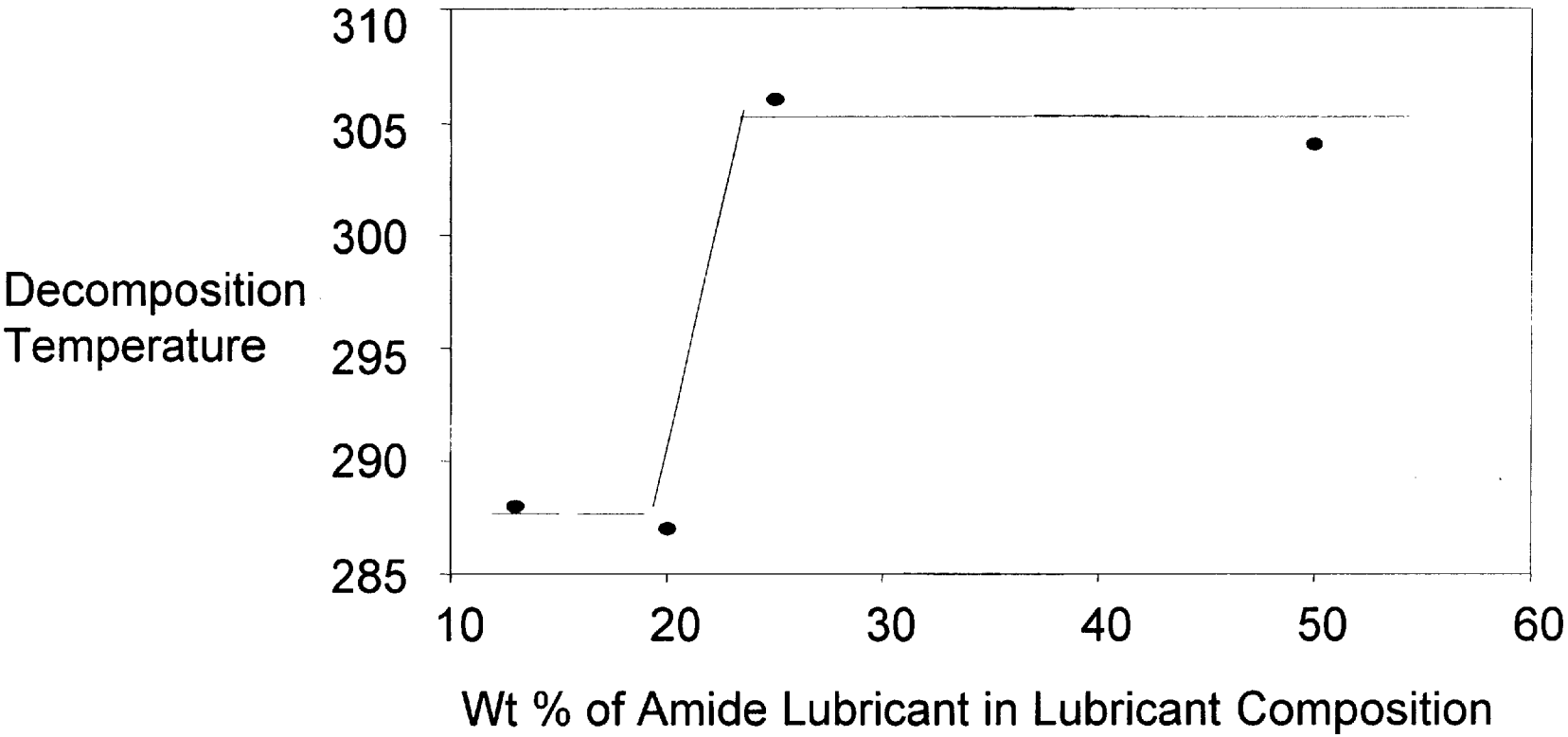
FIG. 4 graphically illustrates the thermal stability of a lubricant composition of the present invention.

FIG. 4 further demonstrates the benefit of the lubricant compositions of the present invention by graphically illustrating the decomposition-inhibiting effect of an amide lubricant. The graph demonstrates the thermal enhancement of an amide lubricant in a lubricant composition with a convention PFPE as a function of weight percent of the amide lubricant. As shown, admixing about 25 wt. % of an amide lubricant together with a convention PFPE lubricant improves the thermal stability of the lubricant composition from about 287° C. to about 305° C.

Solutions of the lubricant compositions of the present invention can be formed by simply dissolving the lubricant compositions of the present invention in a hydrofluorocarbon to produce a homogeneous solution. The prepared solution can then be easily applied to a magnetic recording medium as, for example, to form lubricant topcoat 14 in the magnetic recording medium depicted in FIG. 1. In accordance with the present invention, the lubricant topcoat can be advantageously applied by submerging a disk in the lubricant solution for a sufficient period of time to form a lubricant topcoat on the disk and removing excess lubricant, as by hand wiping.

As previously disclosed, the lubricant solution in accordance with the present invention can be applied by hand wiping or mechanical wiping techniques after immersing a disk in a lubricant solution. A disk ready for application of a lubricant topcoat is soaked in the lubricant solution, removed from the solution and hand or machine wiped, as with a clean cotton wipe. In this manner, a homogeneous topcoat lubricant comprising the first and second lubricant having a thickness ranging from about 10 Å to about 100 Å can be obtained depending upon the formulation and wipe procedure.

The present invention is not limited to any particular type of magnetic recording medium, but can be employed in any of various magnetic recording media, including those wherein the substrate or a subsequently deposited layer has been textured, as by mechanical treatment or laser techniques, and the textured surface substantially reproduced on subsequently deposited layers. Thus, a lubricant composition prepared in accordance with the present invention, can be applied to form a topcoat, such as topcoat 14 on the magnetic recording media depicted in FIG. 1, but not necessarily limited thereto.

Only the preferred embodiment of the invention and but a few examples of its versatility are shown and described in the present disclosure. It is to be understood that the invention is capable of use in various other combinations and environments and is capable of changes or modifications within the scope of the inventive concept as expressed herein.

What is claimed is:

1. A magnetic recording medium comprising a magnetic layer and a lubricant composition on the magnetic layer, wherein the lubricant composition comprises a first fluoropolyether substituted with one or more hydroxyl groups and a decomposition-inhibiting amount of a second fluoropolyether having at least one nitrogen containing end-group, and wherein the first fluoropolyether is a perfluoropolyether and the second fluoropolyether has the formula:

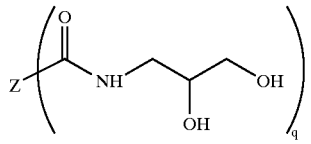

wherein Z is a fluorinated polyalkylether and q is 2.

2. A lubricant composition comprising a first fluoropolyether substituted with one or more hydroxyl groups and a decomposition-inhibiting amount of a second fluoropolyether, wherein the second fluoropolyether has at least one nitrogen containing end-group, and wherein the first fluoropolyether is a perfluoropolyether and the second fluoropolyether has the formula:

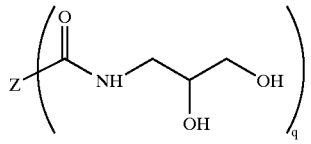

wherein Z is a fluorinated polyalkylether and q is 2.

* * * * *